United States Patent [19]

Ranz et al.

[11] 3,941,595

[45] Mar. 2, 1976

[54] PHOTOGRAPHIC MATERIAL CONTAINING FOGGED, DIRECT POSITIVE SILVER HALIDE EMULSION AND NEGATIVE SILVER HALIDE EMULSION FOR THE PRODUCTION OF EQUIDENSITIES

[75] Inventors: Erwin Ranz; Otto Lapp, both of Leverkusen; Erik Moisar, Cologne; Harald von Rintelen, Leverkusen, all of Germany

[73] Assignee: AGFA-Gevaert, A.G., Bayerwerk, Germany

[22] Filed: Nov. 20, 1972

[21] Appl. No.: 308,119

[30] Foreign Application Priority Data

Nov. 20, 1971 Germany ..... 2157636

[52] U.S. Cl. ..... 96/27 E; 96/452; 96/64; 96/61 R; 96/63; 96/68; 96/69; 96/107; 96/108

[51] Int. Cl.[2] ... G03C 1/76; G03C 1/28; G03C 5/04

[58] Field of Search .. 96/64, 68, 69, 45.2, 107–108, 96/27 E, 33, 63, 61

[56] References Cited

UNITED STATES PATENTS

| | | | |
|---|---|---|---|
| 2,996,382 | 8/1961 | Luckey et al. | 96/68 |
| 3,146,105 | 8/1964 | Wrisley et al. | 96/33 |
| 3,178,282 | 4/1965 | Luckey et al. | 96/68 |
| 3,607,278 | 9/1971 | Ditzer et al. | 96/68 |
| 3,615,443 | 10/1971 | Smith | 96/33 |
| 3,637,388 | 1/1972 | Ranz et al. | 96/69 |
| R25,885 | 10/1965 | Yackel et al. | 96/33 |

*Primary Examiner*—Won H. Louie, Jr.
*Attorney, Agent, or Firm*—Connolly and Hutz

[57] ABSTRACT

Equidensity images can be produced by imagewise exposure and photographic processing of a photographic material containing at least two silver salt emulsions which may be arranged in one layer as a mixture or in two layers, wherein one silver salt emulsion is a fogged direct positive emulsion and the other is a negative emulsion.

10 Claims, 2 Drawing Figures

Figure 1:
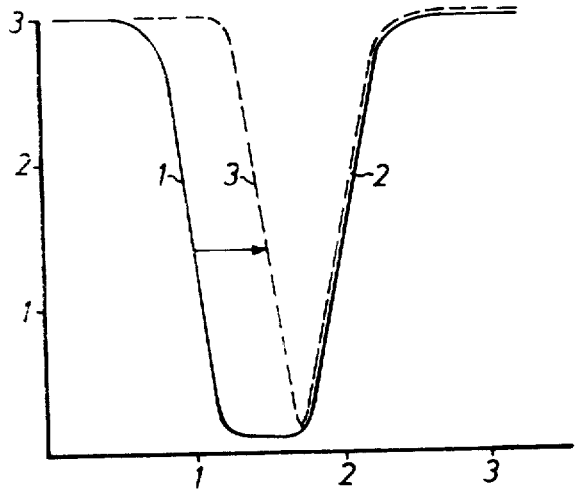

PHOTOGRAPHIC MATERIAL CONTAINING FOGGED, DIRECT POSITIVE SILVER HALIDE EMULSION AND NEGATIVE SILVER HALIDE EMULSION FOR THE PRODUCTION OF EQUIDENSITIES

This invention relates to a photographic material and to a process for producing photographic equidensity images.

It is known that lines of equal density (equidensities) can be obtained from a copy by photographic processes. There are numerous fields of application for equidensometric processes, for example, they may be used for increasing the accuracy of measurement when interpreting interferograms, or they may be used in sensitometry, photometry, the photometry of spectral lines, fine measurement techniques (examination of profiles, examination of surfaces), the examination of optical systems, serial photographs, X-ray photographs, astronomical photographs, etc.

The simplest photographic process for producing equidensities is one in which a negative is first produced from a transparent positive. The two are then brought into registration with each other, either exactly or with a slight shift. A copy of this combination of negative and positive then provides a sort of equidensity. The disadvantages of this process are the difficulties of bringing the negative and positive into exact registration with each other and the distance between the two layers, which may give rise to faults in the copy.

It is also known to make use of the Sabattier effect for producing equidensity images. This process enables a negative and positive to be formed in one layer, which is an advantage over the first process. In this process, the exposed photographic layer is partly developed and then diffusely re-exposed before development is continued to the required extent. Relatively broad and flat equidensities are obtained in this way which can be improved by repeated copying on to photographic material having a steep gradation. One particular disadvantage of this process is that the Sabattier effect is difficult to reproduce, particularly because it is required to re-expose the layers while they are still moist with very little permissible margin of error. Moreover, there are only a few emulsions which manifest a satisfactory Sabattier effect. Methods for the photographic production of equidensities have been described in some detail in "Die Aquidensitometrie" by E. LAU and G. KRUG (publishers Akademie-Verlag Berlin, 1957).

It is also known to produce photographic equidensity images by a method based on the principle of the bromine ion diffusion process. For this purpose, a photographic material is used which contains a major quantity of relatively insensitive silver halide emulsion which is soluble in the developer which is to be used and a minor quantity of more highly sensitive silver halide emulsion which is insoluble in the developer. Only developers which are free from potassium bromide and contain a solvent for the less sensitive emulsion are suitable for this purpose.

Although, equidensity images of superior quality can be obtained by this process, difficulties arise from the fact that special developers must be used and from the need for careful adjustment of the two silver halide emulsions in the light-sensitive photographic material to each other.

It is among the objects of the present invention to provide new photographic materials and processes for producing equidensity images by which equidensity images of superior quality can be easily obtained using processing baths of conventional compositions.

We now have found a photographic material containing at least two silver salt emulsions which may be arranged either in one layer as a mixture or in two layers in which one of the silver salt emulsions is a fogged direct positive emulsion and the other is a negative emulsion and in which the direct positive emulsion has a higher sensitivity to light upon the exposure used for producing equidensities than the negative emulsion while the spectral sensitivity may be the same or different. The above material is processed to yield equidensity images by imagewise exposure and subsequent development and fixing.

The mode of operation of the photographic material according to the invention is illustrated in FIG. 1. In this diagram the exposure log I.t is plotted as axis of abscissa against the density as the axis of ordinates. The characteristic curve differs from conventional curves of this kind in that it is composed of a positive branch (curve 1) of the direct positive emulsion and a negative branch (curve 2) of the negative emulsion.

The gap between the positive and negative part of the characteristic curve represents the equidensity. Images of areas or lines of equal density on a photographic copy are obtained in this way. In other words, only a certain range of light is effective for the recording. Higher or lower exposure causes blackening of the recording material. The distance between the positive and negative branch of the curve indicates the breadth of the equidensity.

From FIG. 1 it is seen that in order to obtain such a characteristic curve with a gap, the direct positive emulsion must have the greater sensitivity to light at the given exposure.

If the two emulsions have the same relative spectral sensitivity, the equidensity range is fixed and cannot be varied by altering the spectral composition of the light. Since it is usually of particular interest to be able to obtain a narrow equidensity range, i.e. a narrow gap in the characteristic curve, the sensitivity of the two emulsions should preferably be chosen so that equidensities with a density range of 0.1 can be obtained. According to a particular embodiment of this invention, the two emulsions have different spectral sensitivities. It is thus possible by varying the spectral composition of the light used for producing equidensities, e.g. with the aid of color filters of different densities, to vary the equidensity range as desired within wide limits. Spectral sensitization of the two emulsions can be adjusted so that, for example, when exposing with white light corresponding to a color temperature of 2800°K, the ratio of the relative sensitivity of the direct positive emulsion to that of the negative emulsion is 10:1 or 1:10.

In the first case, the characteristic curve obtained consists, as shown in the attached figure, of a positive branch and a negative branch with a gap between them (curves 1 and 2). In order to obtain a narrower gap, it is necessary to reduce the intensity of light in the spectral sensitivity range of the more highly sensitive emulsion, i.e. the direct positive emulsion. Characteristic curve 1 is thus shifted to the right; curve 3 is obtained and hence a narrowing of the gap is obtained. Widening of the gap is achieved by reducing the intensity of light in the spectral sensitivity range of the less sensitive emulsion, in this case the negative emulsion.

Figure 2:
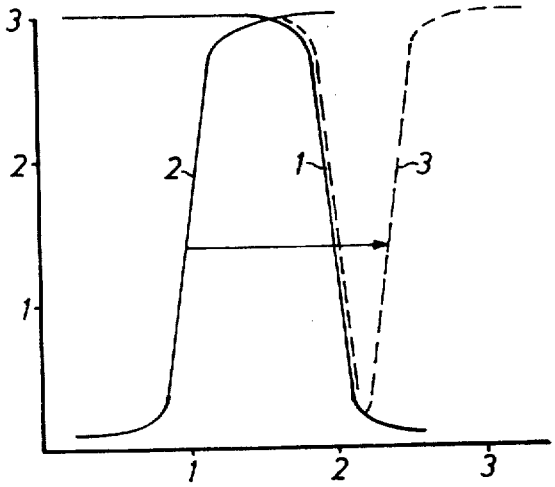

If, as in the second case, the negative emulsion is more sensitive than the positive emulsion, then under the conditions described above, e.g. exposure with white light of 2,800°K, the positive characteristic curve of the direct positive emulsion would overlap the negative branch produced by the negative emulsion. In that case a totally blackened layer would be obtained (sum of the curves 1 and 2 in FIG. 2). A gap of the characteristic curve is therefore obtained only if the intensity of light in the spectral sensitivity range of the negative emulsion is suppressed. Fortunately, this can be achieved by using suitable color filters. The characteristic curve 2 in the attached FIG. 2 is thus shifted to the right; curve 3 is obtained and hence a gap of the required breadth.

The light-sensitive silver salts used for both emulsions are preferably silver halides. The silver halide of these emulsions may consist of silver chloride, silver bromide or mixtures of the two which may also contain small amounts of silver iodide of, for example, up to 10 mols-% according to the desired properties of the material.

The direct positive emulsions used may in principle be any known emulsion of this kind. In general, fogged silver halide gelatin emulsions are used. Exposure causes imagewise destruction of the developable fog on the surface of the silver halide grain so that subsequent development of the remaining fog results in a positive image. It is preferred to use direct positive emulsions with silver halide grains which contain ripening nuclei in their interior as described by E. MOISAR and S. WAGNER in "Berichte der Bunsengesellschaft four Physikalische Chemie," 67 (1963), pages 356 – 359. Emulsions of this kind have been described in German Offenlegungsschrift No. 1,597,488 (= U.S. Pat. application No. 760,217). The preparation of silver halide emulsions with a composite grain structure has been described in British Pat. Specification No. 1,027,146. The spectral sensitivity of these emulsions can advantageously be considerably increased by means of the usual sensitizers. Particularly advantageous for use in the material according to the invention are also fogged silver halide emulsions which are free from internal nuclei and in which the sensitivity to light has been increased by the addition of desensitizing dyes as described in British Pat. Specification No. 723,019.

Other direct positive emulsions suitable for this purpose have been described in British Pat. Specification No. 1,186,721 and U.S. Pat. No. 3,501,306 and 3,501,307.

The negative silver salt emulsions required for the material according to the invention are prepared by the usual methods.

These emulsions may also be chemically sensitized, e.g. by the addition of sulfur-containing compounds during chemical ripening, for example allyl isothiocyanate, allyl thiourea, sodium thiosulfate and the like. Reducing agents may also be used as chemical sensitizers, e.g. the tin compounds described in Belgian Pat. Specifications Nos. 493,464 and 568,687 or polyamines such as diethylene triamine or aminomethane sulfinic acid derivatives, e.g. as described in Belgian Pat. Specification No. 547,323.

Noble metals such as gold, platinum, palladium, iridium, ruthenium or rhodium as well as compounds of such metals are also suitable chemical sensitizers. This method of chemical sensitization has been described in the article by R. KOSLOWSKY, Z.Wiss.Phot. 46, 65 – 72 (1951).

It is also possible to sensitize the emulsions with polyalkylene oxide derivatives, e.g. with a polyethylene oxide having a molecular weight of between 1.000 and 20.000, or with condensation products of alkylene oxides and aliphatic alcohols, glycols, cyclic dehydration products of hexitols, alkyl-substituted phenols, aliphatic carboxylic acids, aliphatic amines or aliphatic diamines and amides. The condensation products have a molecular weight of at least 700 and preferably more than 1.000. One may, of course, also use combinations of these sensitizers in order to achieve special effects, as described in Belgian Pat. Specification No. 537,278 and in British Pat. Specification No. 727,982.

The emulsions may also be optically sensitized, e.g. with the usual polymethine dyes such as neutrocyanines, basic or acid carbocyanines, rhodacyanines, hemicyanines, styryl dyes, oxanoles and the like. Sensitizers of this kind have been described in the work by F. M. HAMER "The Cyanine Dyes and related Compounds," Interscience Publishers, a division of John Wiley and Sons, New York (1964).

The emulsion may contain the usual stabilizers, e.g. homopolar or salt type compounds of mercury with aromatic or heterocyclic rings, such as mercaptotriazoles, simple mercury salts, sulfonium mercury double salts and other mercury compounds. Azaindenes are also suitable stabilizers, especially tetra- or pentaazaindenes and particularly those which are substituted with hydroxyl or amino groups. Compounds of this kind have been described in the article by BIRR, Z.Wiss,Phot. 47, 2–58 (1952). Other suitable stabilizers are inter alia heterocyclic mercapto compounds, e.g. phenyl mercaptotetrazole, quaternary benzothiazole derivatives, benzotriazole and the like.

The emulsions may be hardened in the usual manner, for example with formaldehyde or halo-substituted aldehydes which contain a carboxyl group such as mucochloric acid, diketones, methane sulfonic acid esters, dialdehydes and the like. It is further possible to produce colored equidensity images by color-photographic processes well known in the art. The photographic material of the present invention may contain color couplers incorporated homogeneously or heterogeneously in diffusion-fast form. The exposed material is then processed including color-forming development. The colored equidensity may also be produced by the developing — in process known per se. If multilayered color-photographic materials are used which contain in each layer a negative and a directpositive emulsion according to the invention but color couplers for producing different dyes upon color-forming development it is possible to make in one step several differently colored equidensity images with one color-photographic material.

EXAMPLE 1

A silver chloride gelatin emulsion with a relatively steep $\gamma$ —value is mixed in the ratio of 1:1 with a chemically fogged silver-bromide gelatin direct positive emulsion which also has a relatively steep $\gamma$ —value. The silver chloride emulsion is prepared in the usual manner.

The direct positive emulsion used was a homodisperse chemically fogged silver bromide emulsion containing internal ripening nuclei.

The silver chloride gelatin emulsion is sensitized to the green region of the spectrum with a sensitizer of the following formula:

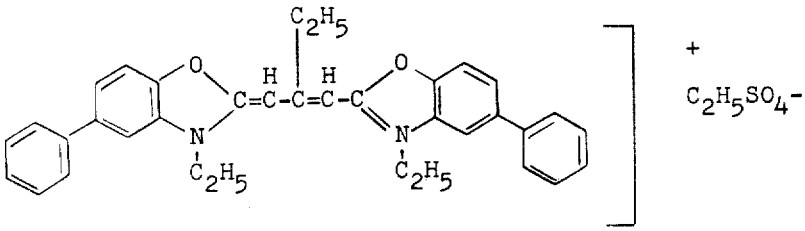

The direct positive emulsion which has not been sensitized is inherently sensitive mainly in the blue region of the spectrum. 5 ml of a 30 % aqueous solution of formaldehyde as hardeners and 50 of a 5 % aqueous solution of saponine as wetting agents are added to 1 kg of the emulsion mixture which is cast on a support of polyethylene terephthalate to a thickness corresponding to about 7 g of silver per m². The sensitivity of the sensitized wilver chloride emulsion on exposure to white light from a tungsten incandescent lamp of 2,750°K is one fifth of the sensitivity of the direct positive emulsion. On exposure with the same light source behind a yellow filter (Agfa yellow color copying filter of density 0.99), the sensitivity ratio of the direct positive emulsion to the negative emulsion is 1.26:1.

In the first case, when exposure is carried out without using a filter, a wide gap is obtained between the positive and negative branches of the characteristic curve. Relatively broad equidensities with a density range of about 0.7 are obtained. On exposure behind a yellow filter, a narrow gap and narrow equidensities are obtained, with a density range of about 0.1. Sensitivity and breadth of equidensities were measured at density 1.0.

The material was developed for 5 minutes in a developer of the following composition:

| | |
|---|---|
| water | 1000 ml |
| p-methylaminophenol | 1 g |
| sodium sulfite anhydrous | 13 g |
| hydroquinone | 3 g |
| soda anhydrous | 26 g |
| potassium bromide | 1 g |

The material was then fixed, washed and dried.

EXAMPLE 2

A silver bromide gelatin emulsion with a relatively high $\gamma$ —value and low speed which has not been spectrally sensitized is cast on a support of polyethylene terephthalate to a thickness corresponding to about 3 g of silver in the form of silver bromide per m². Over this layer is cast a homodisperse chemically fogged silver bromide gelatin emulsion which contains internal ripening nuclei and also has a relatively steep gradation. This serves as the direct positive emulsion and is applied in a thickness which corresponds to about 3 g of silver in the form of silver halide per m².

The direct positive emulsion is sensitized to the red region of the spectrum with a sensitizer of the following formula:

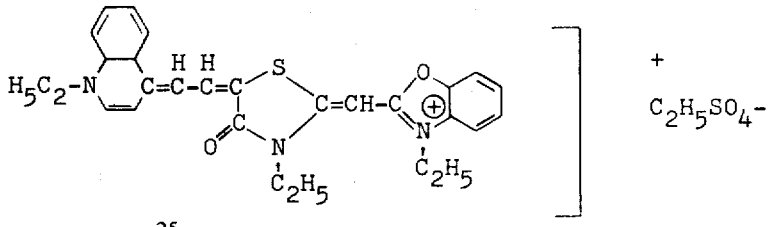

The photographic material prepared in this way is exposed to a white incandescent lamp light of 2,750°K behind a grey test wedge and then processed as described in Example 1, no equidensities are obtained because the sensitivity of the negative emulsion is greater than that of the direct positive emulsion. If, on the other hand, exposure is carried out behind an additional yellow filter (Agfacolor yellow copying filter of density 400), whereby the intensity of light in the blue region of the spectrum to which the negative emulsion is inherently sensitive is reduced then a relatively wide gap is obtained between the positive and negative branch of the characteristic curve. The equidensity range measured at a density of 1.0 in this case covers about 0.3 logarithmic units.

We claim:

1. A photographic material capable of recording equidensity images containing at least two silver halide emulsions as a mixture in one layer, wherein one silver halide emulsion is a fogged direct-positive silver halide emulsion having developable fog on the silver halide grain surface and which yields a positive characteristic curve and the other silver halide emulsion is a negative silver halide emulsion which yields a negative characteristic curve, the sensitivity of the negative emulsion is lower, or is capable of being reduced by altering the composition of the light to which it is exposed so as to be lower, than the sensitivity of the direct-positive emulsion, so that the positive characteristic curve of the direct-positive emulsion and the negative characteristic curve of the negative emulsion do not overlap, the gap between the negative and positive characteristic curve representing the equidensity image.

2. The photographic material of claim 1, containing the fogged direct positive emulsion and the negative emulsion in proportions ranging from 20:80 to 80:20.

3. The photographic material of claim 1, wherein the silver halide emulsions have a different spectral sensitivity.

4. A photographic material capable of recording equidensity images containing at least two layers each comprised of a silver halide emulsion, wherein the silver halide emulsion in one layer is a fogged directpositive silver halide emulsion having developable fog on the silver halide grain surface and which yields a positive characteristic curve and the silver halide emulsion in the other layer is a negative silver halide emulsion which yields a negative characteristic curve, the sensitivity of the negative emulsion is lower, or is capable of being reduced by altering the composition of the light to which it is exposed so as to be lower, than the sensitivity of the direct-positive emulsion, so that the positive characteristic curve of the direct-positive emulsion and the negative characteristic curve of the negative emulsion do not overlap, the gap between the negative and positive characteristic curve representing the equidensity image.

5. The photographic material of claim 4, containing the fogged direct positive emulsion and the negative emulsion in proportions ranging from 20:80 to 80:20.

6. The photographic material of claim 4, wherein the silver salt emulsions have a different spectral sensitivity.

7. Process for the production of equidensity images including the steps of imagewise exposing to a subject a photographic material containing at least two silver halide emulsions as a mixture in one layer, wherein one silver halide emulsion is a fogged direct-positive silver halide emulsion having developable fog on the silver halide grain surface and which yields a positive characteristic curve and the other silver halide emulsion is a negative silver halide emulsion which yields a negative characteristic curve, the sensitivity of the negative emulsion is lower, or is capable of being reduced by altering the composition of the light to which it is exposed so as to be lower, than the sensitivity of the direct-positive emulsion, and the said exposure to light being carried out with or without altering the intensity of the light in the sensitivity range of the direct positive or negative emulsion so that the direct-positive emulsion has a higher sensitivity to light on exposure than the negative emulsion, so that the positive characteristic curve of the direct-positive emulsion and the negative characteristic curve of the negative emulsion do not overlap, developing the exposed material in an aqueous developer bath and subsequently fixing, washing and drying the developed image-bearing material.

8. The process of claim 7, wherein the two silver halide emulsions differ in their spectral sensitivities and wherein by altering the spectral composition of the light used for producing equidensities, the breadth of equidensities are varied.

9. Process for the production of equidensity images including the steps imagewise exposing to a subject a photographic material containing at least two layers each comprised of a silver halide emulsion, wherein the silver halide emulsion in one layer is a fogged direct-positive silver halide emulsion having developable fog on the silver halide grain surface and which yields a positive characteristic curve and the silver halide emulsion in the other layer is a negative silver halide emulsion which yields a negative characteristic curve, the sensitivity of the negative emulsion is lower, or is capable of being reduced by altering the composition of the light to which it is exposed so as to be lower, than the sensitivity of the direct-positive emulsion, and the said exposure to light being carried out with or without altering the intensity of the light in the sensitivity range of the direct positive or negative emulsion so that the direct-positive emulsion has a higher sensitivity to light on exposure than the negative emulsion, so that the positive characteristic curve of the direct-positive emulsion and the negative characteristic curve of the negative emulsion do not overlap, developing the exposed material in an aqueous developer bath and subsequently fixing, washing and drying the developed image-bearing material.

10. The process of claim 9, wherein the two silver halide emulsions differ in their spectral sensitivities and wherein by altering the spectral composition of the light used for producing equidensities, the breadth of equidensities are varied.

* * * * *